United States Patent [19]

Robson

[11] Patent Number: 4,869,302

[45] Date of Patent: Sep. 26, 1989

[54] SPINDLE MOULDER

[75] Inventor: Thomas Robson, Houghton-le-Spring, England

[73] Assignee: Wadkin PLC, Leicester, England Kingdom

[21] Appl. No.: 161,918

[22] Filed: Feb. 29, 1988

[30] Foreign Application Priority Data

Mar. 4, 1987 [GB] United Kingdom ..... 8705025

[51] Int. Cl.[4] ..... B27C 9/00

[52] U.S. Cl. ..... 144/3 R; 29/564; 144/136 R; 144/363; 408/24

[58] Field of Search ..... 144/1 R, 3 R, 136 R, 144/363; 408/24, 25; 29/33 P, 563, 564

[56] References Cited

U.S. PATENT DOCUMENTS 3,008,501 11/1961 Hammer ..... 144/3 R

*Primary Examiner*—W. Donald Bray

*Attorney, Agent, or Firm*—Rodman & Rodman

[57] ABSTRACT

An improved spindle moulding machine for cutting mouldings in timber and other workpieces comprises at least two rotary cutting spindles mounted on a support frame with their respective axes of rotation parallel to each other and mutually staggered in the direction of their axes. Each rotary spindle is provided with a separate support table for supporting a workpiece relative to the spindle and drive means are provided for rotating the spindles.

5 Claims, 2 Drawing Sheets

SPINDLE MOULDER

Figure 1:
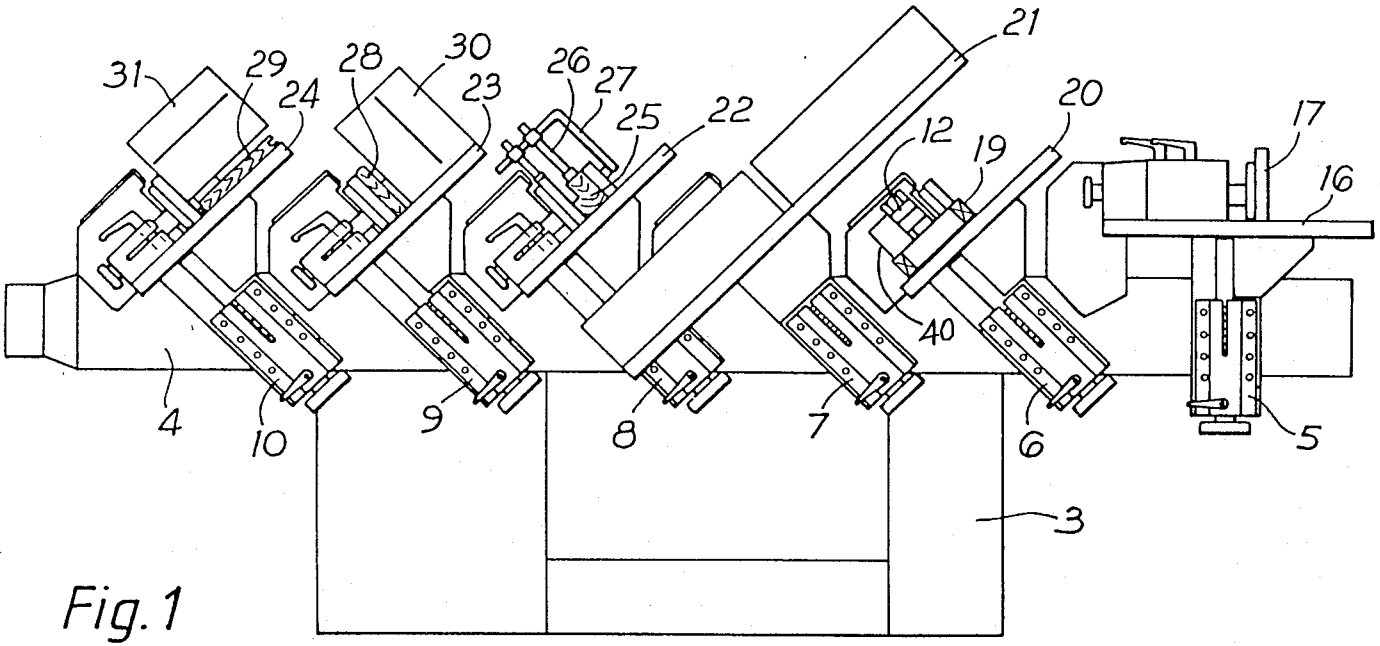

The present invention is an improved spindle moulder, that is an improved machine of the type which is used for cutting grooves and other continuous features along a surface of a piece of timber or of a plastics material or composite material of generally similar working characteristics.

Moulding in this manner using a cutter mounted upon a rotary spindle is a feature of a large number of industrial woodworking operations and machines have been developed which allow repetitive cutting of grooves and other shapes in a succession of workpieces at a high production rate. However, when it is desired to cut a different moulding using the same machine, the machine must be adjusted to a new setting for the new moulding and this operation, to a greater or lesser extent depending upon the specific type of machine, is a time-consuming exercise and involves a measure of skill on the part of the operator.

For example, one available form of spindle moulding machine comprises two or more cutters mounted down the length of a single rotary spindle. When it is desired to cut a new moulding profile, the spindle must be re-set by moving it axially so that a new cutter is aligned with the work table.

In another form of spindle moulding machine, a choice may be made among as many as eight moulding profiles by swinging one of two different spindles laterally into play and then adjusting the selected spindle axially to select one of up to four cutters mounted on the spindle. The design of such a machine is relatively complicated and again the adjustment and re-setting entailed in changing the moulding profile requires a skilled operator.

Yet another form of spindle moulding machine which is already available comprises a number of different spindles spaced around the circumference of a rotary circular turret, enabling a selected spindle to be brought into a fixed cutting zone by rotation of the turret. Each spindle carries two or more cutters so that a number of different mouldings may be cut but of course the design of the machine is inevitably more complicated and the depth and height of mould must be re-set for each change of moulding profile.

Often it is desired to produce on a repetitive basis a large number of identical workpieces, each of which requires the cutting of two or more different moulding profiles. For example a wooden window frame may have at least two different profiles down different sides or on different faces. To manufacture a number of identical such workpieces, it is necessary either to cut a first moulding in all of the workpieces and to store them before adjusting the machine and cutting the second and successive mouldings, or to use two or more spindle moulding machines set to the different moulding profiles. The first approach is inefficient in the use of operator time and available space, while the use of two machines is of course expensive and requires more working space.

Against this background, there is clear room for improvement. It is an object of the present invention to provide an improved spindle moulding machine, which may be used to cut two or more different moulding profiles without adjustment.

The improved spindle moulding machine according to the present invention comprises a support frame, at least two rotary spindles mounted upon the support frame with their respective axes of rotation parallel to each other, the spindles being mutually staggered in the direction of the axes, a separate workpiece support table associated with each rotary spindle for supporting a workpiece in a position adjacent to the spindle, and drive means for rotating the spindles.

While it is possible for the spindles to be mounted with their axes vertical and mutually staggered in a vertical direction, a very advantageous arrangement is for the spindles to be distributed along the length of a generally horizontal support frame with their axes parallel and inclined to the vertical in order to produce the required mutual axial staggering. For example, the spindles may be mounted with their axes inclined at an angle of 20° to 70°, preferably 30° to 60°, to the vertical. In a particularly preferred form of the invention, the spindles are inclined at an angle of 45°.

At least two rotary spindles are provided but because the spindles are mutually axially staggered it becomes possible to mount several spindles quite close together without any spindle impeding the operation of a cutter mounted on the adjacent spindle. Thus the moulding machine may readily comprise three, four, five or six spindles, thereby affording the opportunity of cutting say six different mould profiles without the necessity of re-setting the spindles between cutting operations.

It is possible to add to the flexibility of the machine by making provision for sufficient relative axial adjustment between one or more of the spindles and the table to allow two different cutters to be mounted on the spindle for cutting different profiles. However, in practice, there is little advantage to be gained in this way since the machine may already offer say six profiles without adjustment. Thus, in general, each spindle will carry one cutter.

For each spindle a separate workpiece support table is provided, to support the workpiece while it is fed past the cutter. Similarly, an adjustable fence is provided with each table to allow the depth of cut of the cutter to be varied by varying the position of the workpiece relative to the cutter blade.

It is in general unnecessary, and from the safety standpoint may be undesirable, to operate more than one of the cutters at any time. Thus the drive to the spindles may, if desired, be such as to operate only one selected spindle at a time. It has proved advantageous to drive each spindle by a dedicated electric motor, driven selectively from a common source of power. Thus each rotary spindle may be an extension of the shaft of its associated motor.

A particular advantage of the spindle moulding machine according to the present invention is that, because a common drive may be used to power each of several spindles, it becomes economical to incorporate a frequency inverter in an electrical drive to the spindles. The use of a frequency inverter in this way has two advantages in particular. Firstly, it makes possible the use of higher rotational speeds of the spindles and cutters, for example as high as 6000 rpm or higher. Secondly, most available frequency inverters are automatically self-braking, that is they are self-retarding when the stop button is actuated, so that they convey a significant safety benefit to the machine.

The workpieces may be fed past the respective spindles manually or by means of powered drive rollers, which may press the moving workpiece either against the adjustable fence or against the table according to the position of the profile on the workpiece.

It is particularly preferred that at least one of the workpiece support tables (in the case of a machine with two spindles) and preferably all or most of the tables be mounted so as to be swingable away from the adjacent spindle. This allows the associated cutter to be more readily replaced or maintained when desired but carries the important further advantage of permitting more ready access to the adjacent spindle and table when these are in operation.

Figure 2:
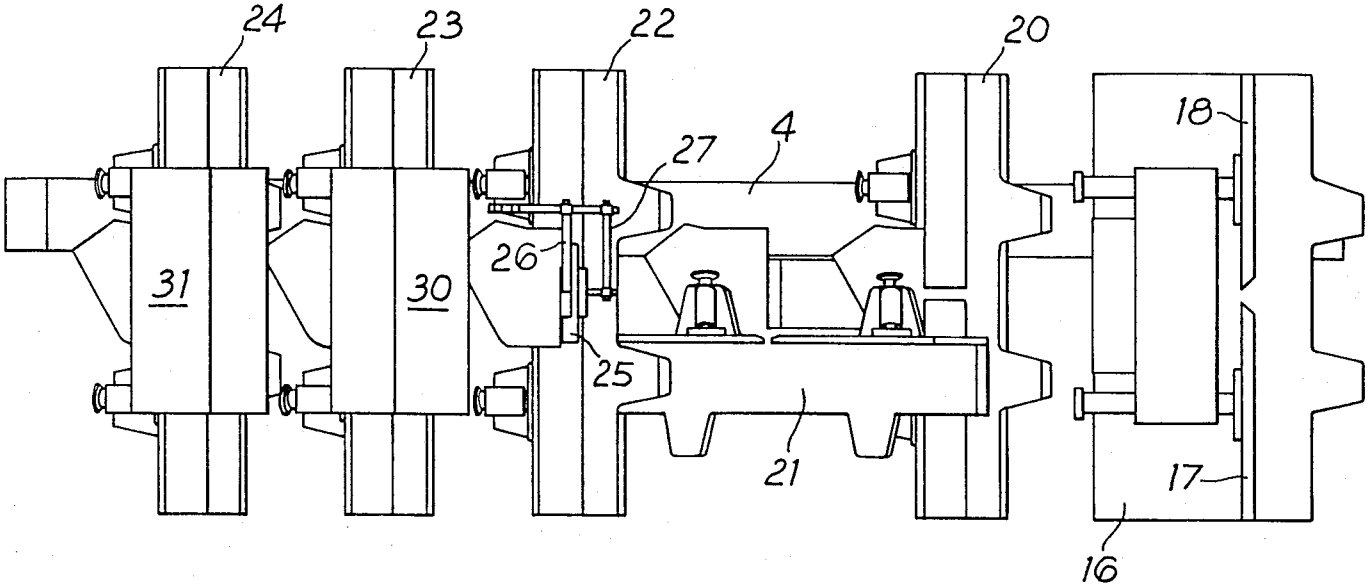

The invention will now be further described, and further optional features thereof will be made apparent, with reference to the accompanying drawings, wherein:

FIG. 1 is an elevational view, partly in section, of one preferred embodiment of the spindle moulder according to the present invention; and FIG. 2 is a plan view of the spindle moulder of FIG. 1.

The illustrated spindle moulder is built upon a support frame comprising a solid base structure 3 and a horizontal hollow beam 4. Along the length of the beam 4 are mounted six electric motors 40 these motors are each behind, and axially parallel to, one of the table-adjustment housings identified by the respective numerals 5 to 10 in FIG. 1 of the drawings. The right-hand motor is mounted with its drive shaft vertical while the remaining motors are mounted, in parallel, axially staggered alignment, with their shafts inclined at an angle of 45° to the beam 1.

The shafts of the motors are each extended to form the spindles (of which only spindle 12 is visible in the drawings) which carry the respective cutter blades by means of which the required mouldings are cut. The cutters will often be all of different profiles but in some circumstances, for example where the same profile is to be cut on workpieces of different sizes, cutter profiles may be duplicated. In the drawings, each spindle and cutter illustrates a different feature.

The right-hand motor and spindle are mounted with their axes vertical and therefore the associated table 16 lies in a horizontal plane. This arrangement allows the provision of an extended table, or removable or foldable table extensions, if a large workpiece such as an assembled window frame or door is to be profiled. Adjustable fences 17 and 18 are set to determine the depth of cut.

The mounting of the end table 16 horizontally, and the readiness of access to that table, makes possible its use as a standard spindle cutter table and it may therefore, if desired, be provided with any or all of the features and fittings available for such tables. Such features include provision for the table to tilt or slide; optionally available fittings include a ring fence and contra-rotating cutters.

The spindle 12 is the first in sequence of the inclined spindles and carries a cutter 19 which rotates to cut a moulded profile in a workpiece (not shown) supported on an inclined table 20. Similarly, the remaining inclined spindles have associated inclined tables 21 to 24 and adjustable fences. A motor for driving the spindle 12 is schematically shown at 40 in FIG. 1.

Each of the tables 20 to 24 and associated fences are pivotally mounted so that they can individually be swung upwards and sideways into the position in which the table 21 is illustrated. This swinging action affords access to the spindle to allow the cutter to be replaced or serviced. More importantly it allows a machine operator to stand closer to the adjacent table 22 when the associated spindle is in operation.

The table 22 is illustrated as arranged for manual feeding of a timber workpiece 25, the position of the workpiece against the cutter being maintained by Shaw guards 26, 27.

Tables 23 and 24 are shown arranged for automatic feeding of workpieces 28 and 29 by feeder units 30 and 31 respectively. The unit 30 is placed to press the face of the workpiece 28 against the fence to give a moulding on that face, for example in shaping a skirting board. The feeder unit 31 presses the workpiece 29 against the bed 24, the profile being cut along one edge of the workpiece, for example in the manufacture of tongue-and-groove boards.

While each of the spindles is illustrated in a different cutting mode, in practice they may be set in similar or different modes as required.

The motors are supplied with power from a common electrical source via a frequency inverter of which the output is continuously variable from 0 to say 100 cycles/sec. Only one motor is energised at a time, the motor being chosen by a selector switch which is designed to ensure that no motor can be operated until all of the other motors are switched off.

Wood dust from the cutters is removed via a common extractor duct within the beam 4, having a separate input slot for each cutter which can be opened when the associated cutter is in operation.

It will readily be seen that the spindle moulder according to the present invention, as exemplified by the illustrated embodiment, provides a facility for cutting an assortment of different profiles, in the same or different workpieces, without the necessity of re-setting the spindles. In one particular method of operation, the machine may be operated by two operators standing upon opposite sides of the machine, feeding workpieces back and forth between them.

I claim:

1. An improved spindle moulding machine for cutting continuous features along a surface of a piece of timber or similar material which machine comprises a generally horizontal support frame, at least two rotary spindles mounted in spaced-apart positions on said support frame along the length of said support frame, said spindles having respective axes of rotation parallel to each other and inclined to the vertical whereby to effect a mutual axial staggering of said axes, a separate workpiece support table associated with each rotary spindle for supporting a workpiece in a position adjacent to the spindle, and drive means for rotating the spindles.

2. A spindle moulding machine according to claim 1 wherein the spindles are inclined at an angle lying within the range from 20 degrees to 70 degrees to the vertical.

3. An improved spindle moulding machine comprising a generally horizontal support frame, at least three rotary spindles mounted upon said support frame, at least two of said spindles being spaced along said support frame with their axes parallel to each other and inclined to the vertical, whereby the spindles are mutually staggered in the direction of their axes, a separate workpiece support table for each said spindle for supporting a workpiece in a cutting relationship against said spindle, a separate electric motor for rotating each said spindle, and each said motor being driven from a common source of power.

4. A spindle moulding machine according to claim 3, wherein an end one of said at least three spindles is mounted upon said support frame with the axis of said spindle vertical.

5. A spindle moulding machine according to claim 3, wherein at least one of said workpiece support tables is mounted to be swingable away from the associated spindle.

* * * * *